US006140611A

United States Patent [19]

Penard

[11] Patent Number: 6,140,611

[45] Date of Patent: Oct. 31, 2000

[54] PROCESS FOR SUPPLYING HEAT TO AN OBJECT AND CONTAINER FOR KEEPING DISHES HOT AND REHEATING DISHES

[75] Inventor: Michel Penard, Villy-le-Marechal, France

[73] Assignee: Societe Industrielle de Production de l'Aube, Saint-Phal, France

[21] Appl. No.: 09/301,681

[22] Filed: May 1, 1999

[30] Foreign Application Priority Data

May 4, 1998 [FR] France ..... 98 05608

[51] Int. Cl.[7] ..... F27D 11/00; H05B 3/16

[52] U.S. Cl. ..... 219/385; 219/543

[58] Field of Search ..... 219/385, 386, 219/522, 541, 543, 547, 548; 338/308, 309, 323, 324, 327, 330; 312/236

[56] References Cited

U.S. PATENT DOCUMENTS

| | | | |
|---|---|---|---|
| 3,686,473 | 8/1972 | Shirn et al. | 219/219 |
| 3,995,249 | 11/1976 | Ferry | 338/292 |
| 4,002,883 | 1/1977 | Hurko | 219/543 |
| 4,093,041 | 6/1978 | Davis et al. | 186/45 |
| 4,115,750 | 9/1978 | Hansen | 337/107 |
| 4,459,470 | 7/1984 | Schlichta et al. | 219/522 |
| 4,737,757 | 4/1988 | Senda et al. | 338/308 |
| 4,889,974 | 12/1989 | Auding et al. | 219/543 |
| 5,019,797 | 5/1991 | Marstiller et al. | 338/333 |
| 5,577,158 | 11/1996 | Kallgren et al. | 392/433 |

FOREIGN PATENT DOCUMENTS

| | | |
|---|---|---|
| 0 717 946 | 6/1996 | European Pat. Off. . |
| 36 10 921 | 10/1987 | Germany . |

*Primary Examiner*—Sang Paik
*Attorney, Agent, or Firm*—Pearne & Gordon LLP

[57] ABSTRACT

Container for keeping dishes hot and reheating them, comprising a thermally insulating box and shelves which carry plates consisting of a substrate coated with a film forming an electric circuit and having a thickness of from 1,000 to 5,000 angstroms.

6 Claims, 2 Drawing Sheets

PROCESS FOR SUPPLYING HEAT TO AN OBJECT AND CONTAINER FOR KEEPING DISHES HOT AND REHEATING DISHES

The present invention relates to processes for supplying heat to an object, notably to dishes of food, and to a container for keeping dishes hot or reheating them.

A trolley for keeping dishes hot or reheating them which comprises a heat insulating box and has different shelves is already known. Each shelf has a hotplate consisting of a substrate. On the surface of the substrate is a film of ink which conducts electricity to form an electric circuit. The film is provided with means for connection to an electric current source. When heat is to be supplied to the food located on a tray supported by the shelf, the electric circuit is plugged in. The hotplate heats the tray and hence its contents, thus enabling it to be reheated or kept hot.

These trolleys are used in clinics, prisons and other places where meals are served which are prepared in advance and brought to the respective patients and/or inmates in their rooms or cells. Most often, the meals consist of a dish which has to be eaten hot and a dish to be eaten cold on the same tray carried on the same shelf. It is therefore important that, on the one hand, the hotplate which is placed underneath the dishes to be served hot supplies as little heat as possible to the adjacent dishes to be served cold. Thus, in particular, the American standard requires that the trolley and its heating equipment should be capable of heating a dish intended to be eaten hot to 74° C. within 50 minutes and preferably in a shorter period, whereas the dish on the same tray immediately adjacent to it and intended to be eaten cold should remain at 4.4° C. Generally speaking, it is desirable if the hot dish can be brought to the required temperature in 35 to 40 minutes. To achieve this as far as possible, the dishes containing hot food are placed under a cover or at least a thermal separator is provided on a tray between the hot part and the cold part.

In spite of this, this hot plate technique does not meet the requirements of the American standard mentioned above.

The invention solves this problem by using, as the hot plate, a plate consisting of a substrate with a specular polish made of an electrically insulating material, not a conductive material as in German patent application 3 610 921. On the surface of the substrate on which is placed the object which is to be supplied with heat is a film of metal or metal alloys which forms an electric circuit and has a thickness of from 1,000 to 5,000 angstroms and, preferably, 1,400 to 2,000 angstroms. Preferably, the metal film consists of nickel, chromium or alloys thereof.

Unexpectedly, it has been found that a plate of this kind achieves a constant high temperature on the top of the plate (where the film is located), after the film has been supplied with electrical energy, and on the other hand the bottom of the plate maintains a relatively low temperature, in any case well below that of the plates known hitherto. It is found that a plate of this kind releases heat virtually in only one direction, upwards, with very little loss of heat downwards and to the sides. Moreover, the plate reaches static temperatures in a short time, which means that the time taken for reheating can be shortened. Thus, the American standard mentioned above can be met with relatively gentle heating and a system which, by the very fact that it has inertia hotplates, will tolerate power cuts and consequently will allow the temperature to be maintained after heating up, even if the electric circuit is unplugged, as is the case with a trolley for reheating food, when the meals are given out to the consumers. Thus, a hot zone and a cold zone can be maintained side by side on a single tray without having to make the cooling system excessively large with the consequent drawbacks of cost, volume and weight which are a serious problem in a mobile trolley. Nor is there any need to provide expensive and bulky insulation for hotplates of this type.

The substrate may consist, for example, of glass, tempered glass, glass ceramics or stainless steel. In this case, an electrically insulating film is interposed between the metal plate and the film deposit. It is preferably between 2 and 5 mm thick.

The metal film preferably consists of nickel, chromium or alloys thereof and may be obtained by electron gun bombardment of a metal bar and by passing metal atoms which are detached therefrom onto the surface of the support through a mask.

When the film comprises at least one strip and the thickness of the strip is less on one section that on an adjacent section, the heat supplied to the tops of the two sections may be regulated differently, the heat being greater where the strip is narrower, thus making it possible to subdivide the hot part of the tray into a zone on which there might be a bowl of soup, for example, and a less hot zone for a cooked meal which is to be served hot, but needs less heat than the bowl.

Finally, the electric heating circuit may be divided up as much as required by film resistance, thus making it possible to define hot zones and cold zones on the hotplate, as desired. Thus, according to one embodiment, three connecting wires are provided, the first being relayed to one of the mains terminals, while either the second or third wire or the second and third at the same time are connected to another mains terminal and the position of the second and third wires on the film is such that the entire film or part thereof is supplied with electric current. Thus, in order to serve meals in a hospital environment, the same trolley may be used for both midday and evening meals, where the importance of a hot meal as opposed to a cold meal varies considerably.

In the accompanying drawings, which are provided solely by way of example:

Figure 4:
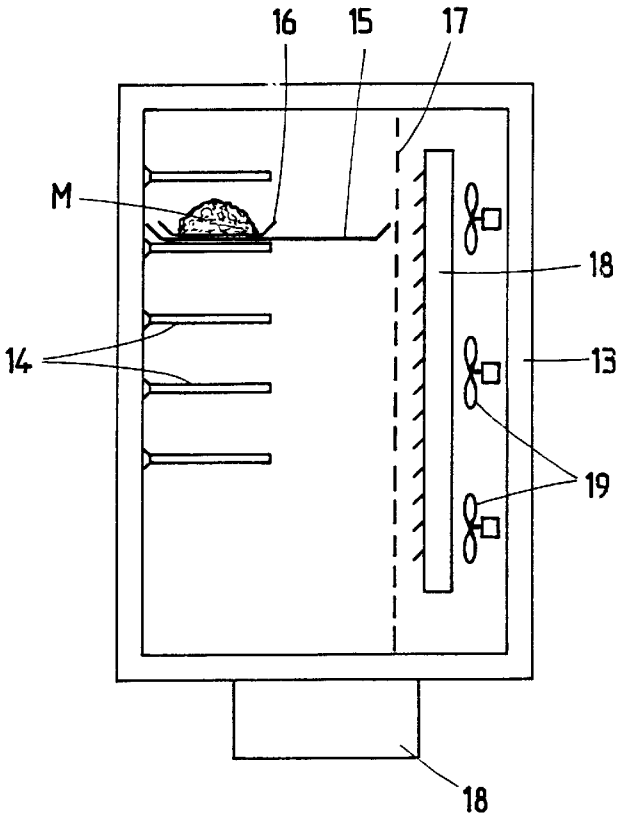
FIG. 4 is a diagrammatic sectional view of a container for keeping dishes hot or reheating them.
Figure 1:
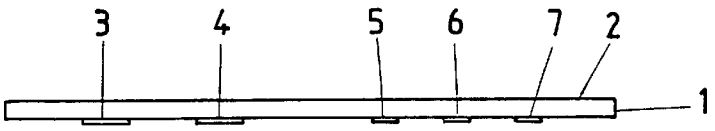
FIG. 1 is a sectional view of a hotplate used according to the invention.
Figure 2:
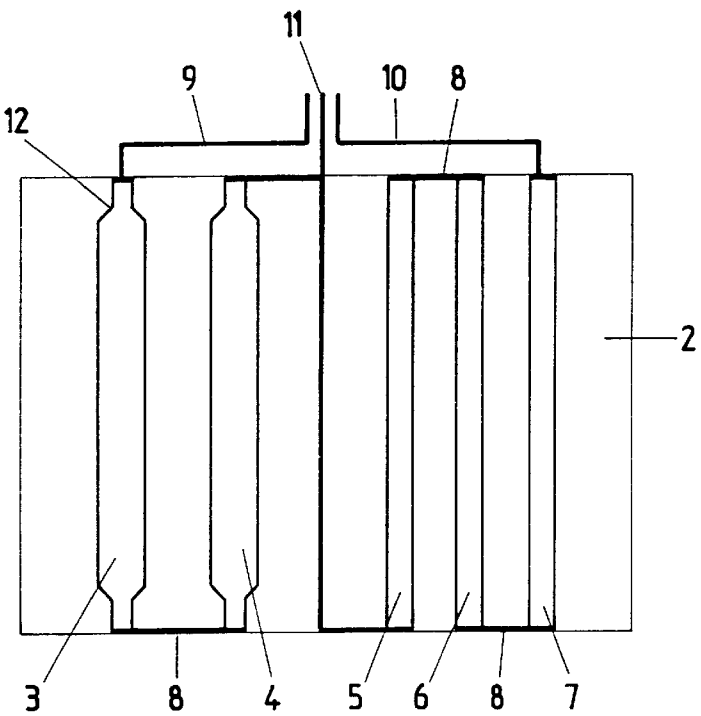
FIG. 2 is a plan view, from above, of a plate corresponding to FIG. 1.

The plate used according to the invention comprises a substrate 1 made of glass with a specular polish under which is a film 2 with a thickness of 1500 angstroms. The film is applied in the form of five strips 3, 4, 5, 6 and 7, the strips 3 and 4 on the left being wider than the strips 5, 6 and 7. These strips are connected to one another along the edges by deposits of conductive metal and are connected to wires 9, 10 and 11 which can be connected to an electric current source.

The strips 3, 4 comprise narrower parts 12 where the heating is therefore greater because the resistance is greater.

Figure 3:
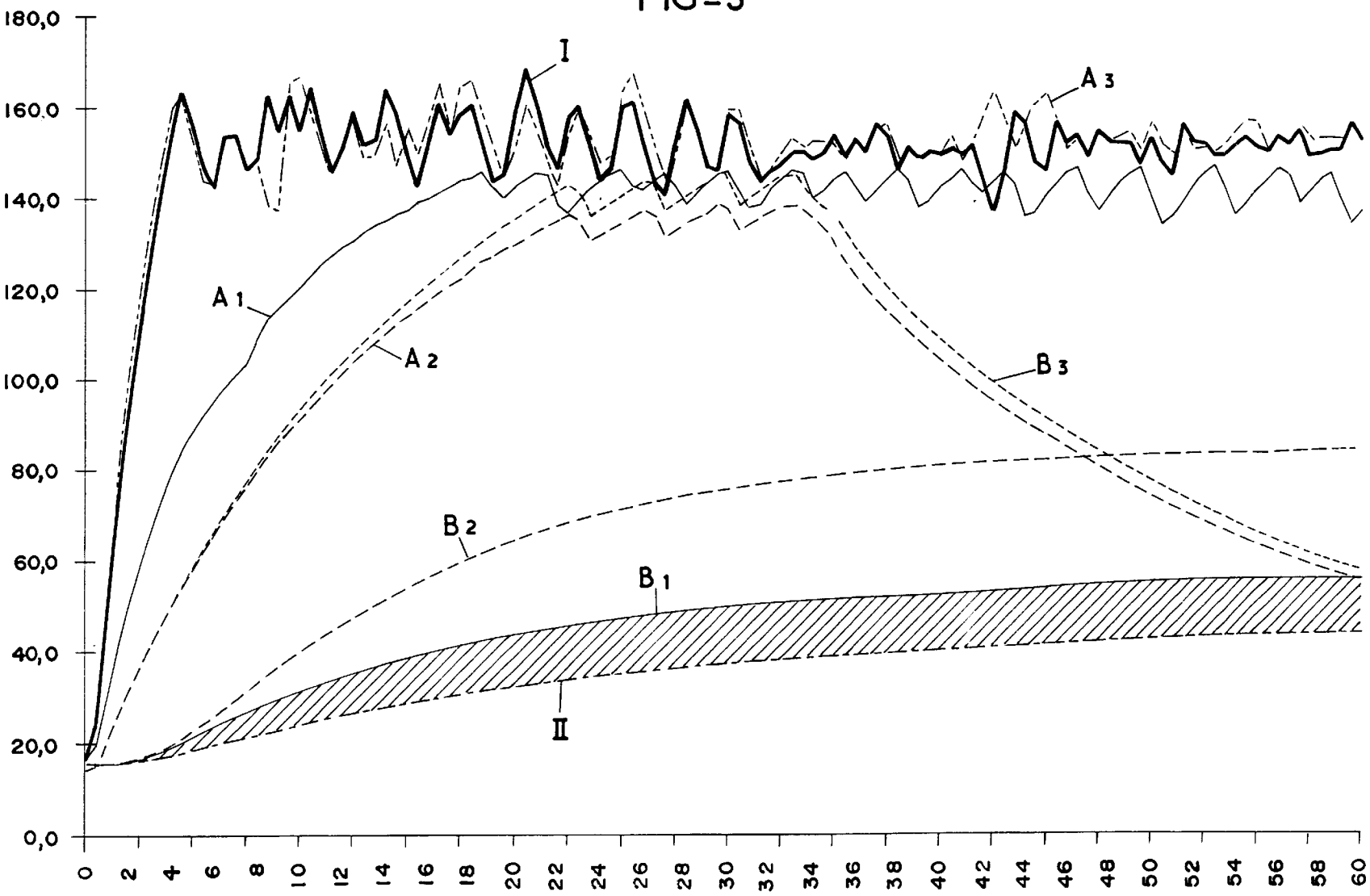
FIG. 3 is a graph illustrating the performance of the plate according to the invention.

FIG. 3 is a graph illustrating the performance of various plates. The x axis shows the time elapsed from the moment when the plates are switched on and the y axis gives the temperatures. The curve 1 gives the temperature of the top of the plate according to the invention and the curve 2 that of the underside of this plate. The curve A1 gives the temperature of the top of a plate on which the electric circuit is deposited in the form of metal ink, while curve B1 indicates the temperature of the bottom of this plate. The shaded area between B1 and 2 is a measure of the progress made by the plate according to the invention which enables it to comply with the USA standards mentioned hereinbefore, whereas with the plate which gives the curves A1 and B1 these standards cannot be achieved. Moreover, the plate according to the invention has a curve 1 in which the temperature of about 150° C. is reached in about three minutes, whereas to reach a temperature of less than about 140° C. it takes seventeen minutes with the plate whose upper surface temperature is indicated by A1. Another plate consisting of a heating fabric stuck to a thin aluminium sheet gives the curves A2 and B2, which are far inferior in every respect to the plate according to the invention. Finally, the curves A3 and B3 are representative of the performance of a conventional moulded aluminium plate. The temperature curve of the top of the plate is substantially equivalent to that of the plate according to the invention, but the temperature of the underside of the plate is very much higher than this.

The container shown in FIG. 4 comprises a heat insulating box 13 and contains shelves 14 which carry plates 15 according to the invention. On the plates are placed trays 16 for dishes containing food M which is to be reheated or kept hot. The plates are connected by their wires to a current source via switches which enable the whole plate or part thereof to be switched on. In the container there is a perforated partition 17 defining a compartment in which is located a cold-generating device 18 and fans 19 distributing the cold in the box, part of the device 18 being located outside the box.

What is claimed is:

1. Container for keeping dishes hot or reheating them, comprising a heat insulating box which contains shelves, at least one shelf having at least one plate and being arranged to support said dishes above said plate, said plate comprising a substrate of an electrically insulating material on one side of which is adhered a metal film, an electric circuit provided with means for connection to an electric current source, said one side being specular and said film having a thickness of between 1,000 and 5,000 angstroms and facing said dishes, said film and said substrate including its specular side orientation cooperating to cause unidirectional heat flow from said film to said dishes supported above said plate and reduce the temperature of the other side of said plate.

2. Container according to claim 1, comprising three connecting wires, the first being connected to a mains terminal, whilst means are provided to enable either the second or third wire or the second and third wires, simultaneously, to be connected to another mains terminal, and the position of the second and third wires on the film is such that as a function of the position of said means the entire film or only part thereof is supplied with electric current.

3. Container according to claim 1, wherein the metal film is made of nickel, chromium or alloys thereof.

4. Container according to claim 1, wherein the film comprises at least one strip having sections and the width of the strip is less on one section than on an adjacent section.

5. Container according to claim 1, wherein electric connecting wires are provided coming from the film.

6. Container according to claim 1, wherein said film thickness is between 1,400 and 2,000 angstroms.

* * * * *